United States Patent [19]

Priesemuth

[11] Patent Number: 4,967,046

[45] Date of Patent: Oct. 30, 1990

[54] AUTOMOTIVE CONTACT SWITCH ARRANGEMENT WITH ESSENTIALLY PLANAR SWITCH SPRINGS

[76] Inventor: Wolfgang Priesemuth, Postkamp 13, 2210 Brittenburg-Nordoe, Fed. Rep. of Germany

[21] Appl. No.: 369,776

[22] Filed: Jun. 22, 1989

[30] Foreign Application Priority Data

Dec. 31, 1988 [DE] Fed. Rep. of Germany ..... 3844484

[51] Int. Cl.[5] ..... H01H 21/36

[52] U.S. Cl. ..... 200/339; 200/315; 200/461

[58] Field of Search ..... 200/339, 315, 343, 337, 200/553, 461, 552

[56] References Cited

U.S. PATENT DOCUMENTS 3,144,529 8/1964 Zemke et al. ..... 200/461
3,471,670 10/1969 Norden ..... 200/339
3,513,274 5/1970 Jullien-Davin ..... 200/461
3,609,268 9/1971 Sanchez ..... 200/315
4,336,429 6/1982 Jackson et al. ..... 200/339 X
4,710,858 12/1987 Van Hout et al. ..... 200/315 X

*Primary Examiner*—Renee S. Luebke
*Attorney, Agent, or Firm*—Robert W. Becker & Associates

[57] ABSTRACT

A contact switch having two switch positions that are attainable from a rest or unoperated position via a movable rocker-type button. The contact switch is particularly suitable for the operation of motor vehicle windows, and includes a housing that also accommodates switching elements that include switch springs that are provided with switch contacts. Actuating elements are provided that are articulatedly connected to the button and extend essentially perpendicular to the switch springs, with the actuating elements, as push members, acting upon the switch springs, which are essentially planar.

10 Claims, 2 Drawing Sheets

AUTOMOTIVE CONTACT SWITCH ARRANGEMENT WITH ESSENTIALLY PLANAR SWITCH SPRINGS

Background of the Invention

The present invention relates to a contact switch that has two switch positions that are attainable from a rest or unoperated position via a movable rocker-type button, with the contact switch being particularly suitable for the operation of motor vehicle windows, and including a housing that also accommodates switching elements that include switch springs that are provided with switch contacts.

Especially in the case of electrical switches used in the automotive industry for the actuation of many different functions, these switches must be extremely economical to produce due to the enormous cost pressures in this industry; this prerequisite translates into a relatively simple construction. However, the extremely economical manufacturing ability must in no way be achieved by compromising the operational reliability, especially since the switches in automobiles generally have extremely important switching responsibilities, such as raising and lowering windows, actuating lights, etc., and must therefore be extremely reliable. Due to the ever increasing numbers in a motor vehicle of electrical operating, monitoring, and control devices, the space required for their installation continuously decreases, accompanied by the increasing requirements for operational reliability, for keeping the manufacturing costs low, and for the miniaturization of such elements and devices, especially switches.

It is therefore an object of the present invention to provide a contact switch, especially for the operation of motor vehicle windows, that is economical to manufacture, is simple in construction, is extremely operationally reliable, and has considerably smaller outer dimensions than do heretofore known switches of this type.

Brief Description of the Drawings

This object, and other objects and advantages of the present invention, will appear more clearly from the following specification in conjunction with the accompanying schematic drawings, in which:

FIG. 1*d* is a bottom view of the switch of

FIG. 1*a* showing the plug means;

Summary of the Invention

Figure 1D:
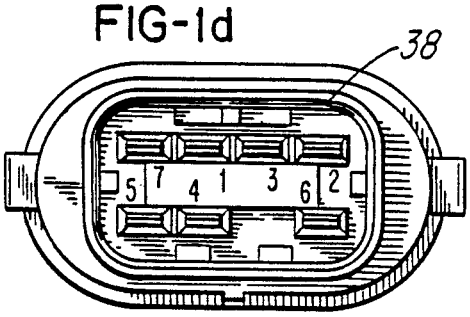
Figure 1A:
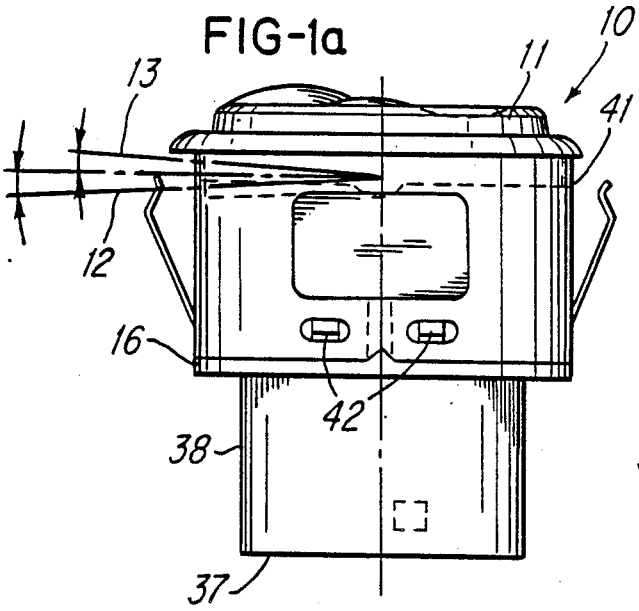
FIG. 1*a* is a view of one wide side of one exemplary embodiment of the inventive contact switch.
Figure 1B:
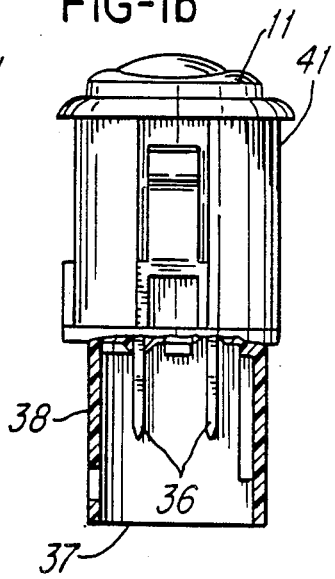
FIG. 1*b* is a view of one narrow side, partially in section, of the switch of FIG. 1*a;*
Figure 1C:
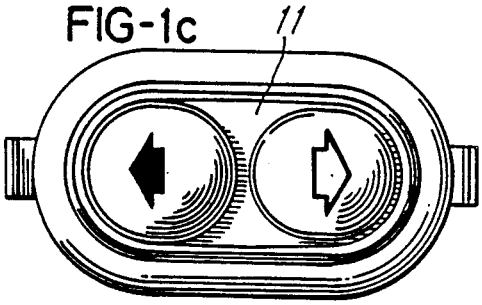
FIG. 1*c* is a top view of the button of the switch of FIG. 1*a;*

The contact switch of the present invention is characterized primarily by actuating elements that are pivotably connected to the button and extend essentially perpendicular to the switch springs, with the actuating elements, as push members, acting upon the switch springs, which are essentially planar.

The advantage of the inventively constructed contact switch is essentially that from the viewpoint of achieving a high operational reliability, in other words a reliable switching condition, nonetheless a simple and straightforward construction can be achieved, and in particular by shifting the switching elements to a lower portion of the housing, whereby the switching elements, via actuating elements that act as push members, can be operated by the button, which can be disposed relatively far removed from the switching elements. In addition, the switch, i.e. the switching elements, can be preassembled in a ready for use state, which is important for an economic manufacture. The remaining parts of the switch can be assembled in the manner of an assembly of prefabricated machine parts.

In principle, the actuating elements can be embodied in any desired manner as long as they are suitable to span the free space between the button and the switch springs. However, the actuating elements are advantageously embodied in the form of small flat plates that can be produced in a very straightforward manner in a simple punching process, being made, for example, of metal. Advantageously, the actuating elements are longitudinally displaceably accommodated on two opposite sides in guide means that can be integrally embodied with the housing; this in turn has the advantage that during a prefabricated machine parts type of assembly, the plates are received in a guided manner and it is not necessary to have either an adjustment during assembly or a complicated assembly procedure.

A particularly critical point in switches of this type is the actual switch springs especially where, as in the present case, very high currents are conducted over the contacts, as occurs, for example, during the operation of motors for raising and lowering motor vehicle windows. For cost reasons, these currents are conducted directly over the contacts of the switch and not, as was previously customary, over separate relays that are merely actuated by the switches. During the first test with switches of the inventive type, where the currents of window actuating motors were conducted directly over the switch contacts, it was discovered that while carrying out the switching function, the switch contacts slipped back and forth, which inherently led to an undesired alternating activation of the motors, and in addition very rapidly wore out the contacts of the switch springs. To resolve this problem, it is advantageously proposed pursuant to the present invention that the switch springs have an essentially rectangular, frame-shaped base, whereby, from one narrow side of the switch spring, a strip that has a wave-like cross-sectional configuration extends into the material-free inner region. This strip assures a suitably set prestress of the switch spring, so that as desired or required, a specific adequate minimal pressure of the contacts on the switch spring side, which pressure is independent of the operating force of the button, is exerted upon corresponding cooperating contacts during operation of the contact switch. This minimal pressure is sufficient to completely preclude the back and forth slipping of the switch springs that occurs with heretofore known switches of this general type.

Pursuant to a further advantageous specific embodiment of the present invention, a switch spring holder is disposed between the free ends of the strip and the other narrow side of the switch spring, with the switch spring advantageously being held by holder elements or brackets of the switch spring holder, which brackets are provided with two catch means. In this way, a very simple assembly of the switch spring, and a reliable mounting of the switch spring in the assembled state, are possible. In conjunction with the aforementioned wave-like configuration of the strip of the switch spring, an automatic adjustment during assembly of the switch spring, and an automatic adjustment of the tension of the switch spring, are achieved The catch means in the switch spring holder are advantageously formed by notches or other recessed holding means of the spring switch holder &hat extend essentially parallel to the switch spring.

In order to keep the manufacturing costs for the contact switch as low as possible, pursuant to a further preferred specific embodiment of the present invention the switch spring holder is integrally connected with a plug means (contact tongue) that projects from the housing. The remaining contacts, on which the switch springs, which are provided with contacts, rest in the active and passive state, also extend through the housing on that side that is remote from the button in the form of plug means that can be introduced into socket means. Thus, all contact means, including the switch spring holders, can be integrally embodied with plug means or contact means, and extend to the outside through appropriately provided holes in the housing.

The plug means are advantageously surrounded by a sleeve that is essentially parallel thereto. On the one hand, the sleeve serves to protect the plug means, and on the other hand the sleeve serves for guiding the plug means into a socket mechanism.

It is frequently necessary to display the present operating function of the contact switch, especially when it is dark. In most cases, illuminating devices that are separate from the switch were used for this purpose. These illuminating devices frequently had to be assembled separately or had to be additionally provided at the suitable location during installation of the contact switch in the assembly region. With the inventive contact switch, in the region between the switching element and the button, an illuminating device is preferably provided in n dish-shaped reflector that is open in the direction toward the button. This has the advantage that the illuminating device, just like the reflector, can be easily inserted, even during assembly of the contact switch, and no separate socket or other holder has to be provided for the illuminating device, which would make the switch more expensive. Very suitable as an illuminating device is, for example, a luminous diode that is available in many different colors and that has the advantage over conventional bulbs that while providing a good illuminating power with very little current, it also shows very little loss of power; in other words, an unnecessary generation of heat is avoided.

Finally, it is advantageous to surround the switching elements themselves with a sleeve that can be connected to the housing, for example, via a snap-fit or in any other suitable manner. This makes assembly of the contact switch considerably easier and more economical, since if the sleeve is not yet present during the assembly process, the individual switching elements, either automatically or manually, can be set in place relatively easily, since then access from the outside is possible into the region of the switching elements without interference from a sleeve. Only after the assembly process, including mounting of the button, is concluded, is the sleeve inserted over the button, i.e. from the side of the button, onto the housing and is connected thereto via a snap-fit or in any other suitable manner. After the sleeve has been connected to the housing, assembly of the contact switch is complete and the contact switch is ready to be installed into a motor vehicle or any other mounting location.

Further specific features of the present invention will be described in detail subsequently.

Description of Preferred Embodiments

Referring now to the drawings in detail, the inventive contact switch 10 essentially comprises a housing 16, the interior of which serves to accommodate and hold switching elements 14, 15, as well as a rocker-type button 11 with which the switching elements 14, 15 can be moved out of an unoperated or rest position into two end switch positions 12, 13. In this connection, the button 11 can be pivoted about an axis 43, i.e. about appropriate mounting means that are provided in the housing 16 and that are not illustrated in detail. These mounting means essentially comprise suitable holes that are provided at an appropriate location in the housing 16 and in which engage appropriate projections provided in or on the button 11 and also not shown in detail. In the vicinity of the button 11 and the switching elements 14, 15, the housing 16 is surrounded by a sleeve-like casing 41 that can be connected with the housing 16 via snap-type connector means 42. After the final assembly of the contact switch 10, the sleeve 41 is inserted over the button 11 from above, and engages or interlocks with the aforementioned snap-type connector means 42.

Via snap-type springs 50, 51 that are securely connected to the housing 16, the contact switch 10 can be held at a receiving location, for example a console in a motor vehicle between the driver and passenger seats, so that special, separate securing means are not required.

The lower region, i.e. the underside 37, of the contact switch 10 is embodied in a plug-like manner. In other words, it is provided with a plurality of plug means 36, which are connected or integrally embodied with appropriate contacts of the switching elements 14, 15, as will be described in detail subsequently. In a manner similar to the sleeve 41 that surrounds the top of t he housing 16, the plug means 36 that project out of the housing 16 at the underside 37 are surrounded by a sleeve 38 that extends essentially parallel to the tongue-shaped plug means 36. However, in contrast to the sleeve 41, the sleeve SB is integrally connected with the housing 16. The number of plug means 36 is essentially a function of the number of the circuits that are to be closed or opened in the first and second switch positions; i.e., the switching elements 14, 15 can selectively individually be established as an opener or closer or both.

Figure 2:
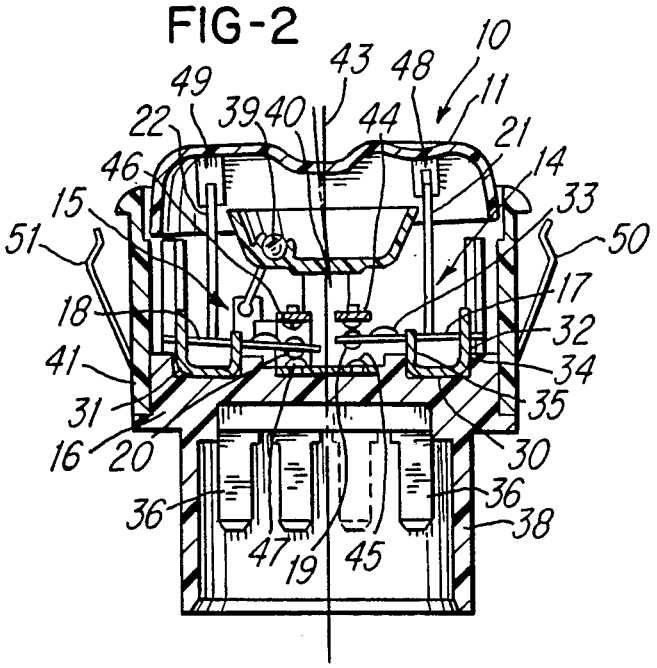
FIG. 2 is a cross-sectional view of the switch of FIG. 1*a,* with nonessential details having been omitted.
Figure 3:
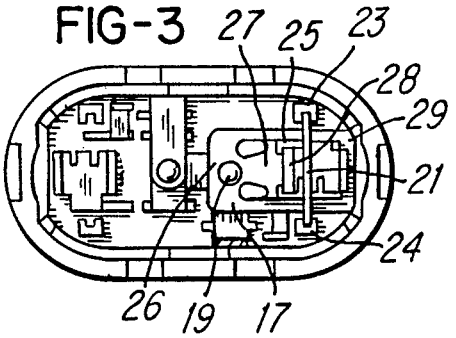
FIG. 3 is a top view of the switch of FIG. 1*a,* with the button and reflector having been omitted, and illustrating merely one of the switch springs with an actuating element that acts thereupon.

Disposed in the region of the base of the housing 16, on opposite sides, is in each case at least one switch spring holder 30, 31 that has two U-shaped holder elements or brackets 34, 35. In the illustrated embodiment, the brackets 34, 35 and the switch spring holders 30, 31 are integrally connected with the respective plug means 36 that are associated therewith. However, it should be understood that such an integral construction of the switch spring holders 30, 31 is not necessary in every case. The brackets 34, 35 are provided with catch means 32, 33 on their respective legs, with these catch means in the illustrated embodiment being formed by notches that are essentially parallel to the base of the housing 16. A respective switch spring 17, 18 is seated in the catch means or notches 32, 33. The switch springs 17, 18 have an essentially rectangular, frame-shaped base, as can be seen from FIG. 3. The switch springs 17, 18 are formed from suitably selected metallic spring material, and constitute a stamped part that is embodied in such a way that from one narrow side 26, a strip 27 having a wave-like cross-sectional configuration extends into the inner region 25 that is free of material (see FIGS. 2 and 3). The free end 28 of the strip 27, and the other narrow side 29 of the switch springs 17, 18, engage the switch spring holders 30, 31 in the region of the notch-like catch means 32, 33. By suitable selection and configuration of the wave-like cross-section of the strip 27, the switch spring 17, 18, after it is brought into engagement with the switch spring holder 30, 31, is prestressed, and in particular in a direction toward appropriate rest and operating contacts 44, 46; 45, 47. These rest and operating contacts 44, 46; 45, 47 can similarly be integral with appropriate plug means 36, and project out of the housing 16 in a direction toward the underside 37. Provided on the first narrow side 26 of the switch spring 17, 18 is a contact 19, 20 that comes into contact with the aforementioned rest or operating contacts 44, 46; 45, 47 when the push button 11 operates an actuating element 21, 22.

The actuating element 21, 22, which acts upon the corresponding switching element 14, 15, is disposed essentially perpendicular thereto. The actuating element 21, 22, which acts as a push member operated by the button 11, is articulated connected to the button 11 and is movable back and forth in guide means 23, 24 that can be embodied as part of the housing 16. The connection of the actuating elements 21, 22, which in this embodiment are embodied as flat plates, to the button 11 is effected via U-shaped strips or rails 48, 49 that are disposed on that inner side of the button 11 that faces the housing 16. That end of the plate-like actuating elements 21, 22 that is remote from the button 11 merely rests upon the essentially flat switch spring 18, 19, and in particular in the vicinity between the two U-shaped brackets 34, 35 of the switch spring holder 30, 31. As can be seen from FIG. 2, the catch means 33 that faces into the center of the housing 16 is offset downwardly in a vertical direction relative to the outwardly facing catch means 32, so that the distance of the catch means 33 to an imaginary housing base is less than the distance of the catch means 32 to the space. As a result, with regard to the switch springs 17, 18 that are received by the brackets 34, 35, i.e. the catch means 32, 33 thereof, when the button 11 is in a horizontal position, i.e. the unoperated position of the contact switch 10, due to the prestress of the wave-like strip 27, the switch springs 17, 18 assume a rest position in which the switch contacts 19, 20 of the switch springs 17 18 are in contact with the respective rest contacts 44, 46. When the button 11 is moved into a first switch position 12 (see FIG. 2), the actuating element 22 is moved by the button 11 in the guide means 23, 24 downwardly in an essentially vertical direction, so that due to the suitably selected wave-like cross-sectional configuration of the strip 27, the switch contact 20 of the switch spring 18 is moved with a predetermined force upon the appropriate fixed switch contact 45, 47, and in particular independent of the force with which the button 11 is move by the person operating the same. Since due to the inventive construction of the switch springs 17, 18, no back and forth slipping of the free end of the switch spring 17, 18 with the corresponding switch contacts 19, 20 results; rather, with a certain minimal force the active switch contact 20 rests upon the appropriate operating contact 45, 47, where it is held, so that in a very simple manner great electrical currents are not switched on only temporarily or intermittently, so that the inventive contact switch 10, if it is used as a window-raising switch for the windows of motor vehicles, does not require a separate interposition of power relays.

Due to the suitably selected spring tension of the switch springs 17, 18, if the button is released, an upward movement of the actuating element 21, 22 is effected due to this spring tension, so that the button can again proceed into a normal, essentially horizontal rest position. It is self understood that both of the switch positions 12, 13 of the contact switch 10 are achieved in the same manner with the same means, so that a separate description of the other switching element, the operation of which was not separately described, is not necessary.

In the region between the switching elements 14, 15 and the button 11, which at least in the vicinity of its symbols is partially light-transparent (see FIG. 3*c*), an illuminating device 39 is disposed in a dish-shaped reflector 40 that is open toward the button 11. Via the illuminating device 39, the respective state of operation of the button 11 can be indicated, and in general the button 11 can be made visible when it is dark outside. The illuminating device 39 can, for example, be a luminous diode of any color, or a minaturized incandescent bulb.

The button 11, the housing 16, the sleeve 38, and the sleeve 41 can be made of an injection molded plastic, such as glass fiber reinforced polyamide. However, in principle any desired suitable type of plastic with or without reinforcement can be used. The actual switch springs 17, 18 are made of suitable metallic spring material, such as spring bronze. The contacts and plug means 36, including those that are integrally connected with the switch spring holders 30, 31, are made of metallic material, for example suitable brass alloys.

The present invention is, of course, in no way restricted to the specific disclosure of the specification and drawings, but also encompasses any modifications within the scope of the appended claims.

What I claim is:

1. In a contact switch that has two switch positions that are attainable from a rest or unoperated position via a movable rocker-type button, with said contact switch including a housing that also accommodates switching elements that include switch springs that are provided with switch contacts, the improvement comprising:

actuating elements that are articulatedly connected to said button and extend essentially perpendicular to said switch springs, with said actuating elements, as push members, acting upon said switch springs, which are essentially planar, each of said actuating elements being in the form of a small, flat plate, said housing being provided with guide means on opposite sides thereof, with said actuating elements being received in said guide means in such a way as to be displaceable in a direction essentially perpendicular to said switch springs.

2. A contact switch according to claim 1 which includes plug means that extend out of said housing on a side thereof that is remote from said button, with said plug means being adapted to be introduced into a socket mechanism.

3. A contact switch according to claim 2, in which said housing is provided with a sleeve that surrounds said plug means and extends essentially parallel thereto.

4. A contact switch according to claim 1, in which each of said switch springs has an essentially rectangular, frame-shaped base with two narrow sides and an inner region that is free of material, with a strip that has an essentially wave-like cross-sectional configuration extending from one of said narrow sides of said switch spring into said inner region thereof.

5. A contact switch according to claim 4, in which said strip has a free end remote from said one narrow side of said switch spring; and which includes a switch spring holder disposed on said housing between said free end of said strip and the other of said narrow sides of said switch spring.

6. A contact switch according to claim 5, in which said switch spring holder is provided with bracket means that in turn are provided with catch means for holding said switch spring.

7. A contact switch according to claim 5, which includes several plug contact means that extend out of said housing in a direction away from said button, with said spring switch holder being integrally connected with one of said plug contact means.

8. In a contact switch that has two switch positions that are attainable from a rest or unoperated position via a movable rocker-type button, with said contact switch including a housing that also accommodates switching elements that include switch springs that are provided with switch contacts, the improvement comprising:

actuating elements that are articulatedly connected to said button and extend essentially perpendicular to said switch springs, with said actuating elements, as push members, acting upon said switch springs, which are essentially planar;

a dish-shaped reflector that is open in a direction toward said button and that is disposed in a region between said button and said switching elements; and an illuminating device disposed in said reflector.

9. A contact switch according to claim 8 in which each of said actuating elements is in the form of a small, flat plate.

10. A contact switch according to claim 8, which includes a sleeve that is adapted to be snapfit onto said housing and surrounds said switching elements.

* * * * *